US005669507A

United States Patent [19]

Pruitt, Jr.

[11] Patent Number: 5,669,507

[45] Date of Patent: Sep. 23, 1997

[54] PALLET BOX CONTAINER

[76] Inventor: John F. Pruitt, Jr., 2140 Audobonm, SW, Wyoming, Mich. 49509

[21] Appl. No.: 633,622

[22] Filed: Apr. 17, 1996

[51] Int. Cl.[6] ..... B65D 19/00

[52] U.S. Cl. ..... 206/600; 206/599; 217/43 A; 217/43 R

[58] Field of Search ..... 206/386, 599, 206/600; 217/12 R, 13, 16, 36, 43 R, 45, 48, 43 A, 17

[56] References Cited

U.S. PATENT DOCUMENTS

| | | | |
|---|---|---|---|
| 600,762 | 2/1898 | Armstrong et al. | 217/48 |
| 2,442,651 | 6/1948 | Johnson | 217/48 |
| 4,914,874 | 4/1990 | Graham, Jr. | 217/43 A |
| 5,109,986 | 5/1992 | Pruitt . | |
| 5,381,915 | 1/1995 | Yardley | 206/600 |
| 5,555,980 | 9/1996 | Johnston et al. | 206/386 |

FOREIGN PATENT DOCUMENTS

| | | |
|---|---|---|
| 2624831 | 6/1989 | France . |
| 674732 | 7/1990 | Switzerland . |

*Primary Examiner*—Paul T. Sewell
*Assistant Examiner*—Luan K. Bui
*Attorney, Agent, or Firm*—Price, Heneveld, Cooper, DeWitt and Litton

[57] ABSTRACT

The specification discloses a collapsible pallet box or container composed of a pallet platform and four upright panels connected together at the corner edges by flexible material to form a polygon expandable to a rectangle or collapsible to a flattened parallelogram. The bottom of the polygon panels are removably attached to the pallet. The tops of the panels have a stabilizing grid with interconnected compression elements between the panels to stabilize the panel tops in the expanded rectangular configuration, and interconnectable, releasable hook and loop fasteners on the grid and on the polygon upper end, at the corners of the grid and recessed into the corners of the polygon, to keep the grid secured to the polygon and thereby keep the polygon locked to the pallet.

11 Claims, 4 Drawing Sheets

PALLET BOX CONTAINER

SUMMARY OF THE INVENTION

An object of this invention is to provide an improved collapsible pallet box container assembly having the advantages of the prior patented structure, but with improved stability of the assembly when even very rough handling conditions occur.

The novel container has its collapsible polygon retained in secure interconnected relationship to the pallet by a locking grid of interconnected compression members. The locking grid is held securely to the polygon by hook and loop fasteners on tensile ribbons at the corners of the polygonal containers. Attachment and detachment of these hook and loop fasteners is readily performed when desired, but detachment does not accidently occur. This grid, as so held, securely retains the base of the polygon in interlocking relation to the pallet by the uniquely retained grid holding the panels in place.

The collapsible polygon walls can be totally enclosing so as to retain smaller items such as produce, e.g., apples or small manufactured parts or the like, or can be partially open so as to retain larger items such as plants, nursery stock, large manufactured parts, produce such as watermelons, bagged potatoes, or the like.

These and other objects and advantages of the invention will become apparent to those in the art upon studying the following specification in conjunction with the drawings.

DESCRIPTION OF THE PREFERRED EMBODIMENT

Referring now specifically to the drawings, the pallet container assembly 10, sometimes designated a pallet box container, includes an upper collapsible polygonal subassembly 12 interfitted with a lower pallet subassembly 14.

In the depicted embodiment, the term "ends" of the assembly is used for convenience to refer to one pair of opposite vertical panels or walls while the other pair called the "sides" are here shown to be the pair of opposite vertical panels or walls that hook onto the pallet. Obviously, all four panels can be considered to be "side panels," in one manner of speaking. The two opposite panels that hook onto the pallet may be horizontally longer, shorter, or of the same length as the other two panels. Thus, the terms "ends" and "sides" are used for clarity and convenience only.

Pallet subassembly 14 includes a platform typically formed of plywood, plastic and/or a plurality of wood tie boards 17A and 17B, as of oak or the like, mounted by suitable fasteners such as nails or screws onto a substructure formed of a plurality, here three, of spaced parallel girders or runners 18 typically of wood or plastic and formed, for example, of "four by four" or "two by four" inch members. These girders are shown extending across both ends and the center of the pallet, each optionally having a pair of spaced side openings (not shown) to receive a pair of tines of a fork lift. The fork lift tines can also be inserted between the girders in conventional fashion. The layer of boards adds strength as well as serving to support product and enabling appropriate interengagement with the upper subassembly 12, as will be explained more fully hereinafter. Alternatively, the base can be all plastic, i.e., polymeric material such as a molded structure, even without screws or other fasteners. A second, floor-engaging, bottom panel (not shown) may be mounted to the bottom of the girders, if desired. The ends of the girders extend beyond the platform, i.e., beyond the end of boards 17A, to create upper support and stop surfaces 18A (FIGS. 2 and 3) for the lower edges of vertical end panels of the upper subassembly to rest upon, as will be explained hereinafter.

Figure 2:
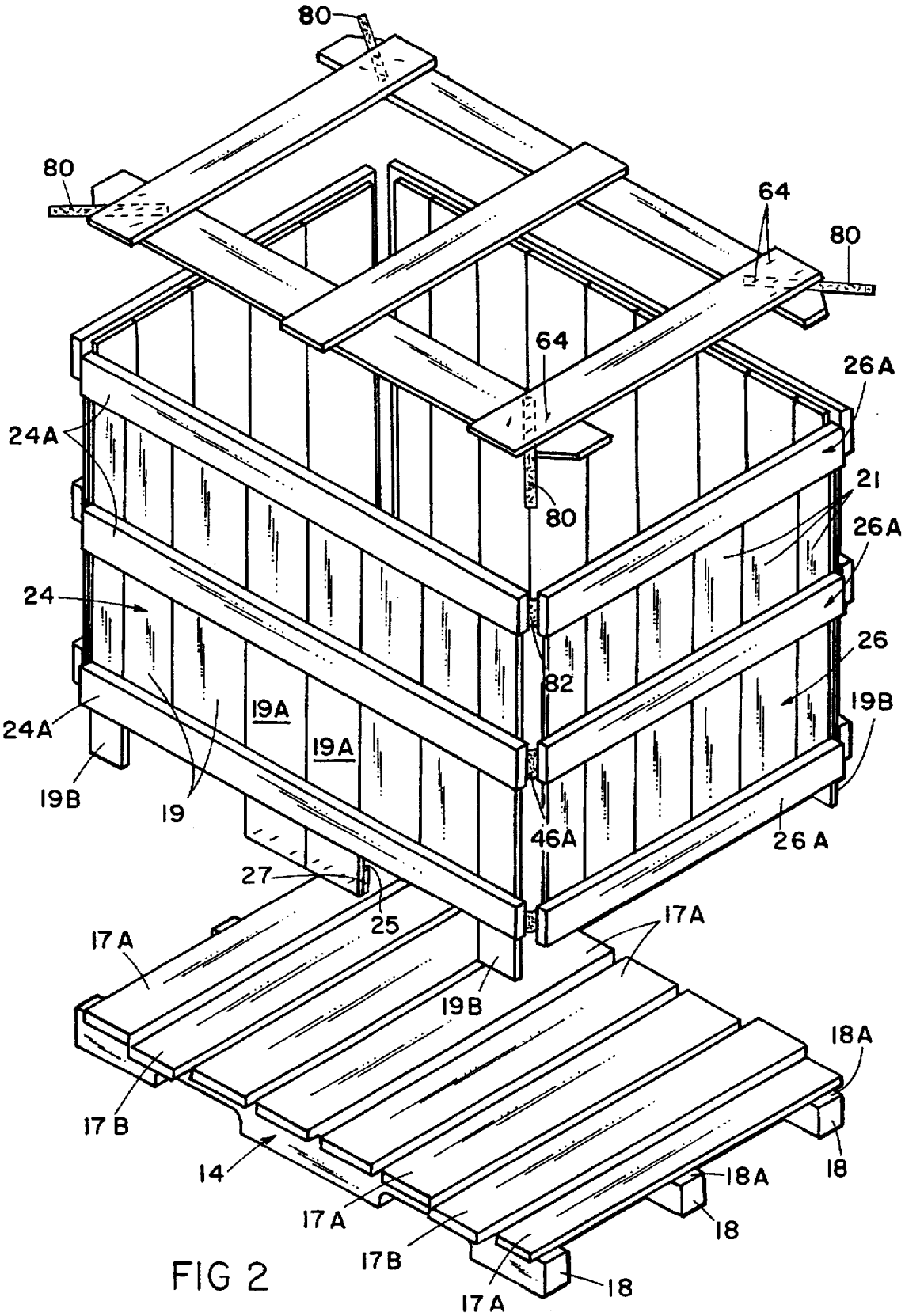
FIG. 2 is an exploded view of the subassembly components of the pallet container in FIG. 1.

The side panels 24 and end panels 26 are shown formed of vertical slats 19 and 21, respectively. As depicted, the panels totally enclose the interior space. However, these slats 19 and/or 21 could be spaced apart to be partially open, if desired. The panels have upper and lower portions. The opposite ends of horizontal boards 17A and 17B extend beyond the outside girders 18 (FIG. 2). As shown, at least two boards 17B have their opposite ends extending further beyond girders 18 as shown here by boards 17B immediately inward of the end boards (FIG. 2). This enables the lower edges of the upper subassembly side panels to rest thereon. The extended ends of the central boards 17A interfit with latching shoulders 25 on the lower inside faces of the downwardly extended, longer, center one or moreslats 19A of vertical slats 19 that form the side walls 24. These shoulders 25 hook beneath the ends of the center boards 17A on opposite sides of the pallet, to form a type of a "tongue and groove" connection to the upper subassembly that prevents the polygon from lifting free of the pallet, as described hereinafter. Optionally, a plywood or other material layer (not shown) on boards 17 could extend beyond the ends of the girders 18 to engage the vertical panels in a like manner to that described.

As noted, collapsible upright polygonal subassembly 12 is formed of a plurality of four vertical panels 24 and 26. The panels are arranged in generally rectangular configuration, the two upright side panels 24 being generally parallel to each other, and the two upright end panels 26 being generally parallel to each other and generally normal to side panels 24 when the polygon is expanded. The vertical end edges of end panels 26 are adjacent to and horizontally spaced slightly from the vertical end edges of side panels 24 formed of slats 19 (including slats 19A). Each of the side panels preferably has a plurality (here three) of vertically spaced, horizontal stringers 24A, to the inner faces of which are attached the slats 19. Similarly, each of end panels 26 is formed with its plurality of adjacent vertical slats 21 secured together by a plurality (here three) of horizontal, vertically spaced, parallel stringers 26A.

Figure 1:
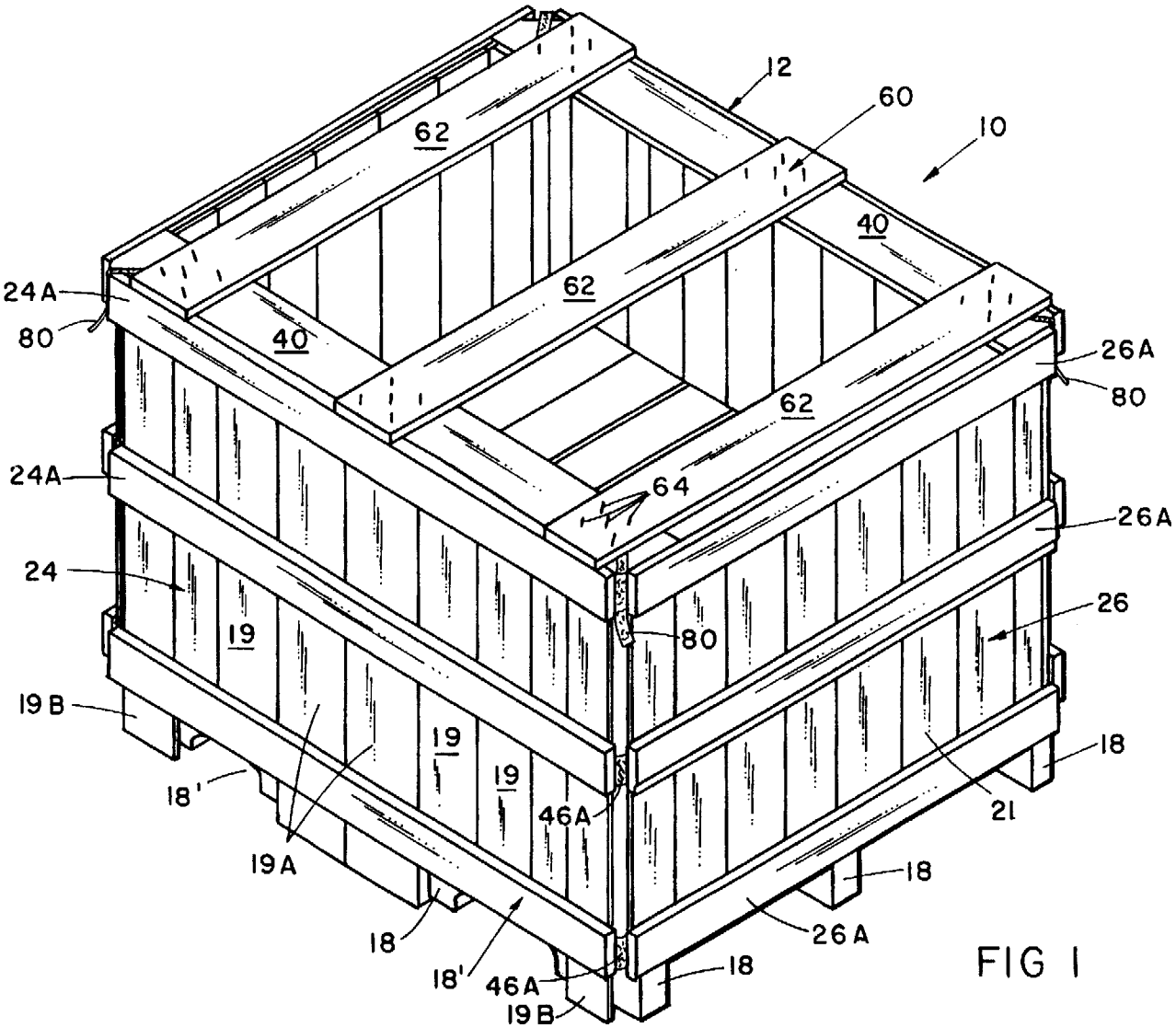
FIG. 1 is a perspective view of one form of the novel pallet container.

Extending between and connecting the edges of each of panels 24 to adjacent edges of panels 26 are a plurality (here three) of upper, lower and intermediate flexible tension means forming connector material, prefrably in the form of straps 46A, preferably of woven polymeric material basically comparable to that conventionally used for vehicle safety seat belts. In order to conserve belting material, these connectors preferably do not extend clear around the inner periphery of the polygonal structure, but rather are in segments at the corners, having the ends thereof fixedly sandwiched and secured between the horizontal stringers and vertical upright slat elements of the side panels and the end panels. This can be achieved by stapling through the upright elements, belt segments and horizontal stringers, and/or adhering the components together. Although three belt segments are shown for each corner, the number thereof could be varied. The belt segments are shown located near the top portion, the central portion, and the bottom portion, respectively, of each of the four corners of subassembly 12. Specifically, belt elements 46A are secured at the corners between the upright slats 19 and 21 and horizontal stringers 24A and 26A as shown by the upper and lower belt elements 46A in FIG. 3. The components thus form a continuum capable of collapse into a flat parallelogram subassembly (FIGS. 4 and 5), or expansion into a rectangular polygon (FIGS. 1 and 2). When the polygon is collapsed or otherwise not attached to the platform, the belts may be slack. When the polygon is expanded and assembled to the platform with the top grid in place, the belts are initially somewhat taut and, when the container is filled, become totally taut. The space enclosed by the polygon could be divided as by a vertical insert divider (not shown), if desired.

In the preferred embodiment, the peripheral dimension of the combined panels and the flexible tension elements in relaxed condition at the base of the polygon is of a length dimension approximately the same as the peripheral dimension of the platform formed by boards 17A and 17B. The connection between the polygon and the pallet is with a hooking connection like a tongue and groove arrangement. In the illustrated embodiments, the center slats 19A on both sides 24 of the polygon are extended down further than the other slats, and have attachment blocks 27 mounted on the inside faces of the lower ends of these slats, to form upwardly facing shoulders 25 (FIGS. 2 and 3) on opposite sides of the polygon, as noted previously. These shoulders 25 hook beneath the outer ends of center boards 17A on pallet 14. This is a similar connection to the tongue and groove connection depicted in U.S. Pat. No. 5,109,986. Using this connection between the polygon and the platform, the bottom periphery of the polygon is engaged around the platform, and the lower belts are caused to be pulled tight, removing slack, to cause the lower end of the polygon to interfit tightly with the pallet. This connection is further stabilized by the special grid at the upper end of the polygon.

This connection of the polygon to the platform can be achieved by first expanding the polygon from its folded condition and resting it on the platform. Then preferably one side 24 of the polygon is lowered and hooked onto the pallet by hooking block 27 below the ends of boards 17A. Then the opposite side is pressed past the boards, lowered and similarly hooked. Outward movement of the second side to hook it can be achieved by striking the lower inner face of this panel with a tool, a fist or a foot. Then one end 26 of the polygon is lowered past the end of the pallet. During this process, there is some temporary vertical offset between at least one of the end panels and the side panels. The flexible straps 46A enable this to readily occur. It will be noted that the drawings show the longer, endmost vertical slats 19B to be extended downwardly to lie adjacent to the other edges of pallet 14. This adds stability.

Figure 3:
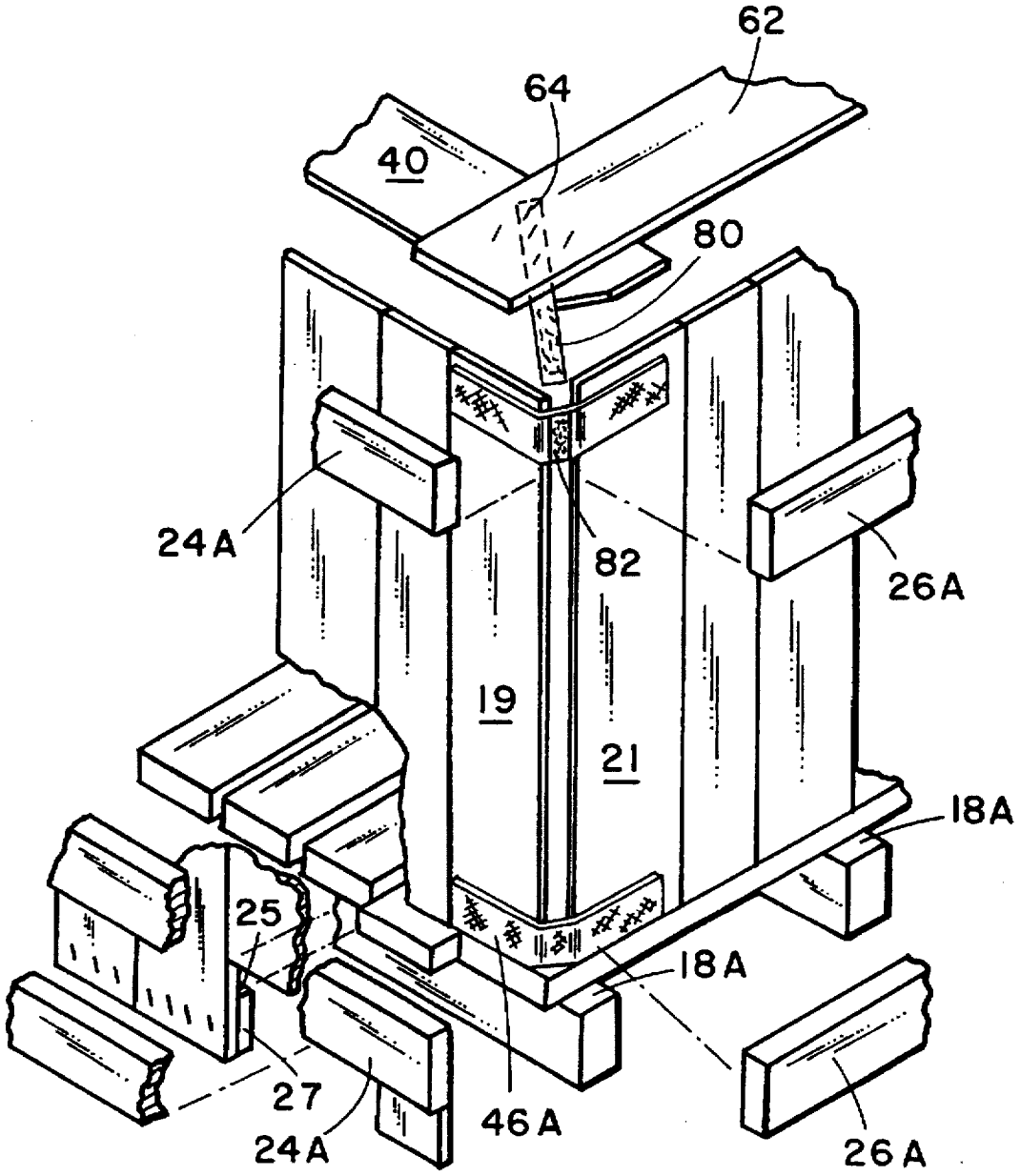
FIG. 3 is a sectional, perspective, exploded view of a corner portion of the pallet container.
Figure 6:
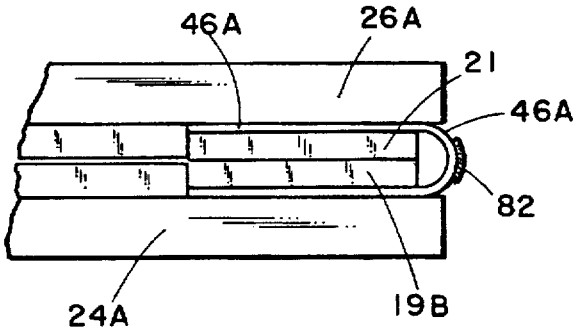
FIG. 6 is an enlarged fragmentary view of the end portion of the collapsed polygon in FIGS. 4 and 5.

After the lower end of the polygon is so attached to the platform, the upper portion of the polygon is stabilized in fully expanded rectangular configuration in a fashion causing the lower connections just noted to be biased inwardly and remain secured. This is done by inserting and securing a novel grid 60 which has a pair of elongated, spaced, wedging compression members 40 such as wood boards, secured together by a plurality, here three, of transverse connectors e.g., boards 62, as by staples 64 or other suitable fastening devices and/or adhesive. This grid could also be made of molded polymer or the like. This grid is lowered and elements 40 are pressed between the upper ends of two of the opposite panels, here shown to be end panels 26 (FIG. 2). Elements 40 are adjacent to and have their long edges snugly engaging the inside upper faces of the other two panels 24, forcing panels 24 outwardly. The opposite outer ends of connector boards 62 preferably overlap the top edges of the side panels 24 to rest thereon and limit vertical insertion of the grid. At the corners of grid 60 are hook and loop devices 80. These employ a plurality of hook and loop fastener elements such as those known as "Velcro"® brand fasteners. Specifically, there are shown to be four flexible ribbons 80 secured at their upper ends to the four corners of grid 60, preferably sandwiched between elements 40 and connectors 62 and held there as by staples 64 or other suitable fasteners and/or adhesive (FIG. 3). These ribbons alternatively have the hooks or the loops thereon. Cooperating with these ribbons are strips 82 (FIG. 3) of material sewn, glued, stapled or otherwise fastened to the outer faces of the corner belts 46A, at the top of the corners of the polygon (FIGS. 3 and 6) and having the alternative loops and hooks thereon, i.e., ribbons 80 can have the loops and strips 82 the hooks, or vice versa. These strips are recessed into the spaces between the panels. When the grid is installed, i.e., forced in place at the top of the polygonal box container, ribbons 80 can be quickly and easily flexed down and pressed into engagement with strips 82 after the grid is firmly in place, to secure the grid. The ribbons 80 are thus nestled into the spaces between the panels, i.e., the ends of stringers 24A and 26A, so as to avoid being accidently lifted or snagged. Yet they are readily accessible. Optionally, supplemental nails, staples or other fasteners can be forcibly inserted down through these compression elements 40 into the underlying shoulder of side panels 24.

Experimentation has shown that this improved construction is highly stable and secure, even under rough handling conditions, and while retaining heavy loads. Yet, the structure can be readily disassembled by pulling ribbons 80 loose, lifting grid 60, removing the upper polygon by lifting each end 26 first over the top of the pallet, then releasing shoulders 25 from the ends of boards 17A, removing and collapsing the polygon.

Figure 5:
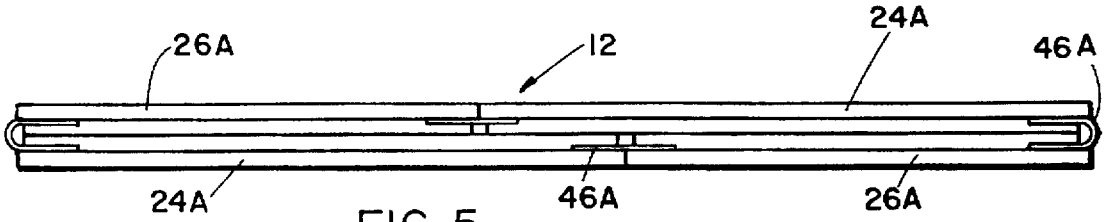
FIG. 5 is a plan view of the collapsed polygon of FIG. 4.
Figure 4:
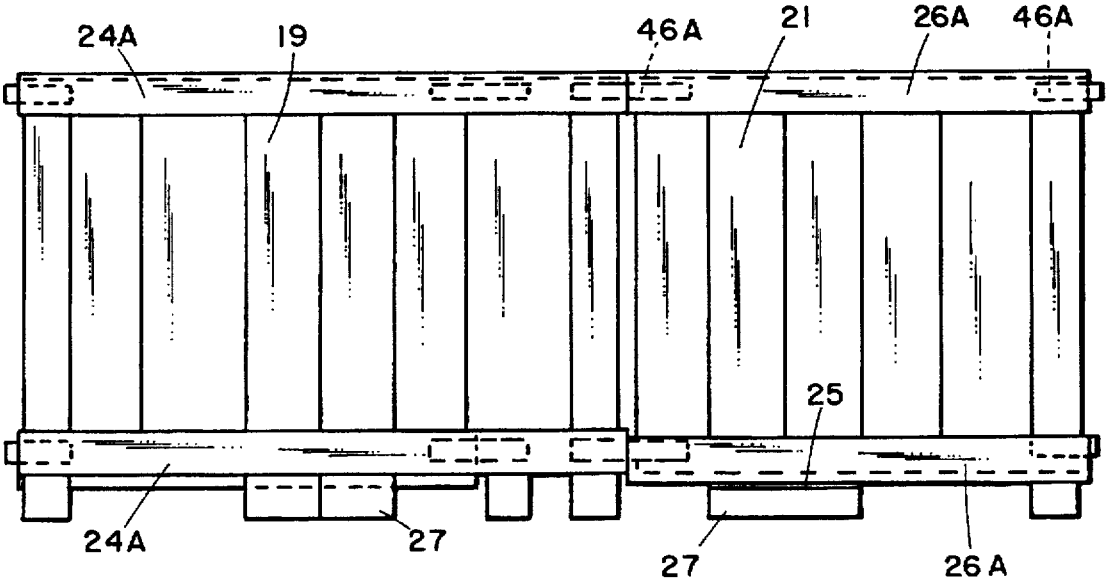
FIG. 4 is a side elevational view of the collapsed upright polygon forming part of the pallet container.

When the assembly is not employed for storing or hauling products, but rather is to be stored or shipped in a compact condition, the upper polygonal subassembly is collapsed into a parallelogram configuration like that depicted in FIGS. 4 and 5, as explained. The collapsed polygon can be laid on the pallet in a compact condition, if desired, or stacked for storage and/or shipping.

The polygon could be secured to the pallet by a plurality of hook and loop fasteners, as by having a plurality of hook-type elements secured to the pallet and a like plurality of cooperative loop-type fasteners on the polygon, or vice versa, the fasteners being secured together around the periphery of the pallet and of the polygon. This could be in addition to the hooked connection depicted, or instead of such.

Conceivably the details of the preferred embodiment of the invention as set forth herein could be modified to suit particular circumstances, materials, or articles to be shipped. For example, the collapsible container and/or the pallet could be made of materials other than wood. The platform could be made of one layer or two. The assembly could also have hooked connections to the pallet at four panels instead of two. The lower edges of the vertical panels could conceivably be removably connected to the pallet by other connections therebetween instead of the tongue and groove connection, or in addition to the tongue and groove connection. Other possibilities or changes will occur to those in the art upon studying this disclosure. Hence, the invention is not intended to be limited to the specific exemplary and preferred embodiment illustrated, but only by the scope of the appended claims and the reasonably equivalent structures to those defined therein.

The embodiments of the invention in which an exclusive property of privilege is claimed are defined as follows. I claim:

1. A collapsible pallet container comprising:

a support pallet having a horizontal platform and undergirders secured beneath said platform;

a plurality of two opposite, upright side panels and two opposite, upright end panels, arranged in a polygon to also form polygon corners;

said side panels and end panels having vertical end edges;

said side panel vertical end edges being adjacent said end panel vertical end edges;

flexible material mounted to said panels and extending between said side panels and said end panels in a manner to secure said panels together in a continuum capable of extension into a rectangular polygon or collapsing into a flattened parallelogram;

said panels having upper and lower portions;

said lower portion of at least two opposite ones of said panels being removably interengageable with said platform;

the improvement comprising:

a removable stabilizer grid having four corners and including compression members for placement between two opposite ones of said upright panels to rigidify said polygon, transverse connectors between said compression members, and interconnectable hook and loop fasteners on said grid and on said polygon for securing said grid in position and thereby forming a stable pallet container, but capable of purposeful disconnection of said hook and loop fasteners for removal of said grid and collapsing of said polygon.

2. The collapsible pallet container in claim 1 wherein said hook and loop fasteners are at least at said corners of said grid and said corners of said polygon.

3. The collapsible pallet container in claim 2 wherein said flexible material is anchored in said panels adjacent said end edges, and hook and loop fasteners on said polygon are on said flexible material.

4. The collapsible pallet container in claim 1 wherein said compression members are snugly adjacent the other two opposite ones of said upright panels.

5. The collapsible pallet container in claim 2 wherein said hook and loop fasteners on said grid are secured between said compression members and said transverse connectors.

6. The collapsible pallet container in claim 1 wherein said undergirders have ends which extend beyond said platform to form support and stop surfaces for said panels.

7. A collapsible pallet container comprising:

a support pallet having pairs of opposite edges;

a collapsible upright polygon having pairs of opposite vertical panels forming lower portions and upper portions of said polygon;

flexible tension means between said panels for binding said panels together such that said polygon is expandable or collapsible;

attachment means between said polygon lower portions and said pallet for mounting said polygon to said pallet; and panel stabilizer means between said polygon upper portions for retaining said polygon upper portions expanded and for keeping said panels attached to said pallet, said panel stabilizer means comprising a removable grid having compression members extending between opposite ones of said panels, connectors between said compression members, and interconnectable, releasable fasteners on said grid and said polygon for securing said grid in position.

8. The pallet container in claim 7 wherein said fasteners are hook and loop fasteners.

9. The pallet container in claim 8 wherein said hook and loop fasteners are at said corners of said grid and said corners of said polygon.

10. The pallet container in claim 9 wherein said flexible tension means is anchored in said panels adjacent said end edges, and said hook and loop fasteners on said polygon are on said flexible tension means.

11. The pallet container in claim 10 wherein said hook and loop fasteners on said flexible tension means are enclosed in said corners.

* * * * *

UNITED STATES PATENT AND TRADEMARK OFFICE

CERTIFICATE OF CORRECTION

PATENT NO. : 5,669,507
DATED : September 23, 1997
INVENTOR : John F. Pruitt, Jr.

It is certified that error appears in the above-identified patent and that said Letters Patent is hereby corrected as shown below:

Col. 1, line 3;

Before "Summary of the Invention" insert all of page 1, lines 2-26, as shown on the attached page.

Signed and Sealed this

Twenty-third Day of December, 1997

Bruce Lehman

*Attest:*

BRUCE LEHMAN

*Attesting Officer*

*Commissioner of Patents and Trademarks*

PALLET BOX CONTAINER

BACKGROUND OF THE INVENTION

This invention relates to pallet box containers.

Pallets to support articles for storage and transport are widely used in industry and commerce. Pallet boxes are typically used to retain loose articles for storage and/or transport. Such pallet boxes are normally made of wood, having the sides of the box secured to the pallet and each other by nails or other fasteners. After receipt of the shipped articles, a good share of the pallet boxes are smashed and burned or otherwise disposed of since the cost of returning the empty containers is too much to make it worthwhile. Of course, this constitutes a waste of resources, as well as potentially adding pollutants and carbon dioxide to the atmosphere, if burned.

In U.S. patent 5,109,986 is set forth a unique collapsible pallet box container that is readily set up from the components of a pallet and a collapsed polygon of panels. The assembly can be largely formed of wood, requires only seconds to set up, is sturdy when used to store and ship articles and, when emptied, can be collapsed flat in seconds to be capable of economical return at reasonable cost to the supplier or elsewhere. The vertical panels are secured together by tensile belting comparable to that used for vehicle seat belts, to have a readily attachable/detachable connection to a pallet, preferably by a snap-in arrangement, and are stabilized at the upper ends of the panels by wedging compression members inserted between opposite panels and tacked to the panels with nails or the like.

It has been determined by experimentation, however, that the compression elements can be accidentally knocked out of position under very rough handling conditions as sometimes can occur. The nails or other fasteners tend to pop out, allowing one or more compression elements to spring free. While the polygonal container may still stay on the pallet, assurance of this is lowered.